US005769619A

United States Patent [19]

Crvelin et al.

[11] Patent Number: 5,769,619

[45] Date of Patent: Jun. 23, 1998

[54] TRACKED ROTARY POSITIVE DISPLACEMENT DEVICE

[75] Inventors: Paul M. Crvelin, Niagara Falls; Giovanni Aquino, Kenmore; Ewan Choroszylow, East Aurora, all of N.Y.

[73] Assignee: Phoenix Compressor and Engine Corporation, East Aurora, N.Y.

[21] Appl. No.: 612,291

[22] Filed: Mar. 7, 1996

[51] Int. Cl.[6] ..... F01C 1/22; F01C 17/04; F01C 19/04; F01C 19/06

[52] U.S. Cl. ..... 418/61.2; 418/116; 418/122; 418/124

[58] Field of Search ..... 418/61.2, 116, 418/122–124

[56] References Cited

U.S. PATENT DOCUMENTS

| | | | |
|---|---|---|---|
| 3,196,848 | 7/1965 | Bensinger | 418/61.2 |
| 3,229,675 | 1/1966 | Hoadley | 418/61.2 |
| 3,242,912 | 3/1966 | Huber | 418/61.2 |
| 3,253,580 | 5/1966 | Eberhard et al. | 418/61.2 |
| 3,260,247 | 7/1966 | Gassmann et al. | 418/61.2 |
| 3,270,718 | 9/1966 | Gassmann | 418/61.2 |
| 3,270,720 | 9/1966 | Ehrhardt | 418/61.2 |
| 3,323,498 | 6/1967 | Kraic et al. | 418/122 |
| 3,465,729 | 9/1969 | Jones | 418/61.2 |
| 3,764,239 | 10/1973 | Huf | 418/61.2 |
| 4,043,714 | 8/1977 | Berkowitz | 418/123 |
| 5,431,551 | 7/1995 | Aquino et al. | 418/61.2 |

FOREIGN PATENT DOCUMENTS

| | | | |
|---|---|---|---|
| 1297620 | 6/1969 | Germany | 418/61.2 |
| 3541820 | 6/1987 | Germany | 418/61.2 |
| 6737746 | 7/1979 | Russian Federation | 418/124 |

*Primary Examiner*—John J. Vrablik
*Attorney, Agent, or Firm*—Howard J. Greenwald

[57] ABSTRACT

A rotary device containing a housing with a curved inner surface in the shape of a trochoid and an interior wall, an eccentric mounted on a shaft disposed within the housing, a rotor mounted on the eccentric shaft and several pins attached to the rotor and extending from the rotor to the interior wall of the housing. A continuously arcuate track is disposed within the interior wall of the housing, and the pins are disposed within the track.

8 Claims, 12 Drawing Sheets

TRACKED ROTARY POSITIVE DISPLACEMENT DEVICE

FIELD OF THE INVENTION

A tracked trochoidal rotary chamber device which can be used for compression and expansion of fluid, pumping of liquid, or as a hydraulic motor.

BACKGROUND OF THE INVENTION

U.S. Pat. No. 5,431,551 of Giovanni Aquino et al. describes a rotary device comprised of a housing, a shaft disposed within said housing, a rotor mounted on said shaft, and a multiplicity of solid cylindrical rollers disposed on the inner surface of said housing and said rotor and rotatably mounted within an external surface of said rotor. The entire disclosure of this Aquino patent is hereby incorporated by reference into this specification.

Although the device of the Aquino patent is advantageous in many substantial respects, it does, however, have certain application related limitations. In the first place, it does not operate efficiently in "dry environments" in which it is not provided with lubrication. In the second place, the device contains some dead volume which cannot be used for compressing fluid but is required because of the device's kinematic requirements. In the third place, the sealing system used in the Aquino device was relatively non-compliant and, thus, limited the use of this device in situations where lubricant was not available during use. In the fourth place, the long-term sealing capabilities of the Aquino device were often compromised after extended periods of use in non-lubricated applications.

It is an object of this invention to provide an improved rotary device which operates substantially as well as the device of U.S. Pat. No. 5,431,551 under lubricated conditions but which, under conditions where lubricant is not present, provides substantially superior durability and sealing than does the device of such United States patent.

It is another object of this invention to provide an improved rotary device comprised of pins which can be cooled more effectively than can the rollers of the device of U.S. Pat. No. 5,431,551.

SUMMARY OF THE INVENTION

In accordance with this invention, there is provided a rotary device comprised of a housing with an interior wall, a shaft disposed within said housing, a rotor mounted on said shaft, and a multiplicity of transversely-extending pins disposed between said interior wall of said housing and an exterior wall of said rotor and located within a track in the shape of a envoluted trochoid.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Rotary piston mechanisms of various types are well known and are disclosed, e.g., in U.S. Pat. Nos. 2,873,250 of Batten, 2,988,065 of Wankel et al., 2,866,417 of Nubling, 3,323,498 of Kraic et al, 3,671,154 of Kolbe et al., 3,797,974 of Huf, 3,923,430 of Huf, and the like. The disclosure of each of these United States patents is hereby incorporated by reference into this specification.

Figure 1:
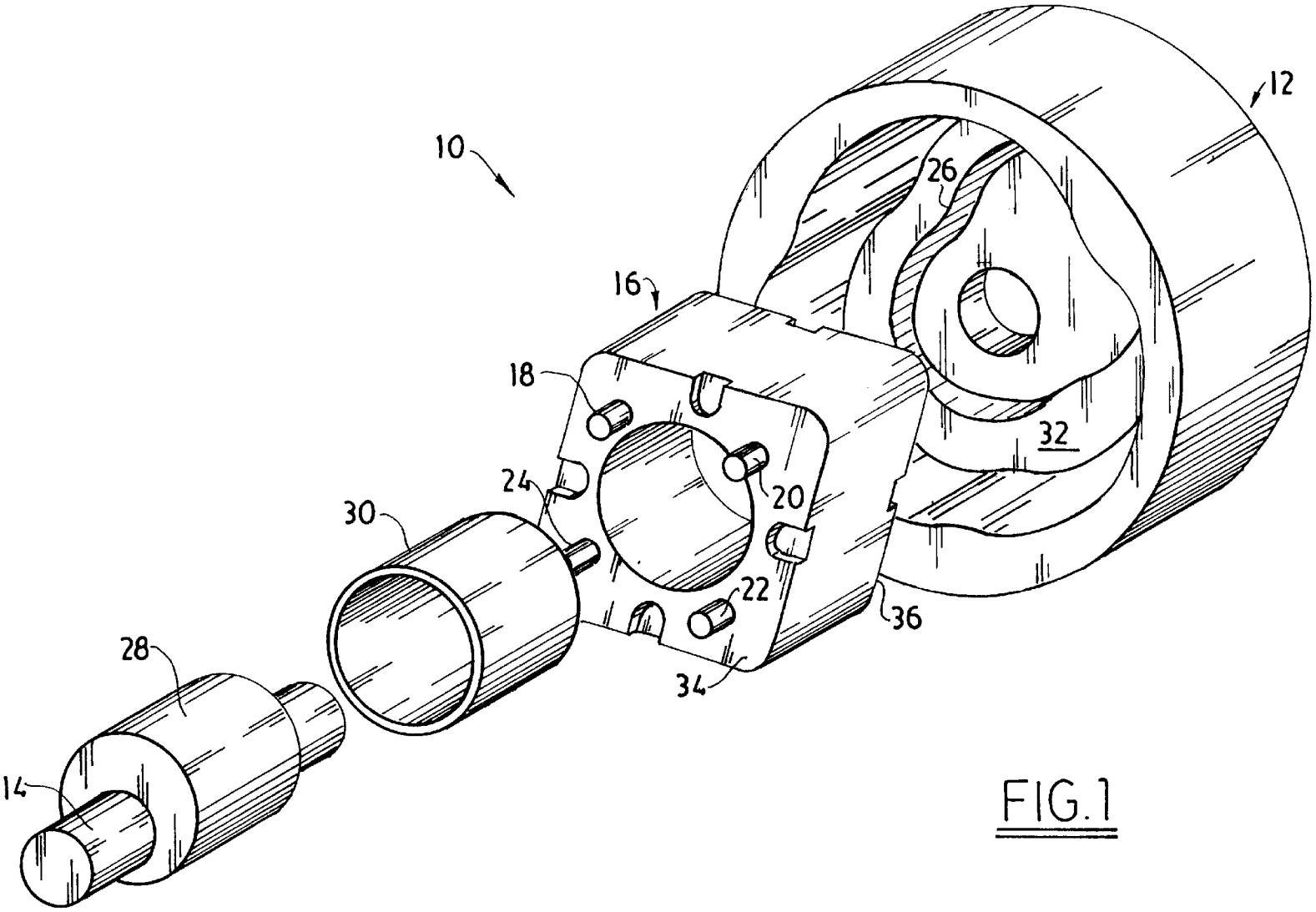
FIG. 1 is a perspective view of one preferred rotary mechanism of this invention.

FIG. 1 is an exploded perspective view of one preferred rotary mechanism 10. Referring to FIG. 1, it will be seen that rotary mechanism 10 is comprised of housing 12, shaft 14, rotor 16, tracking pins 18, 20, 22, and 24, track 26, eccentric 28, and bearing 30.

Referring again to FIG. 1, it will be seen that housing 12 is preferably an integral structure. However, as will be apparent to those skilled in the art, housing 12 may comprise two or more segments joined together by conventional means such as, e.g., bolts.

In one embodiment, housing 12 consists essentially of steel. As is known to those skilled in the art, steel is an alloy of iron and from about 0.02 to about 1.5 weight percent of carbon; it is made from molten pig iron by oxidizing out the excess carbon and other impurities. See, e.g., pages 23–14 to 23–56 (and especially page 23–54) of Robert H. Perry et al.'s "Chemical Engineers' Handbook," Fifth Edition (McGraw-Hill Book Company, New York, 1973). In this embodiment, it is especially preferred to use low carbon steel.

In another embodiment, housing 12 consists essentially of aluminum. In yet another embodiment, housing 12 consists essentially of plastic. These and other suitable materials are described in George S. Brady et al.'s "Materials Handbook," Thirteenth Edition (McGraw-Hill, Inc., New York, 1991).

One advantage of applicants' rotary mechanism 10 is that the housing need not be constructed of expensive alloys which are resistant to wear; and the inner surface of the housing need not be treated with one or more special coatings to minimize such wear. Thus, applicants' device is substantially less expensive to produce than prior art devices.

Housing 12 may be produced from steel stock (such as, e.g., C1040 steel stock) by conventional milling techniques. Thus, by way of illustration and not limitation, one may use a computer numerical controlled milling machine which is adapted to cut a housing 12 with the desired curved surface.

Referring again to FIG. 1, and in the preferred embodiment depicted, it will be seen that housing 12 is comprised of a track 26 disposed in an inner wall 32 of such housing. In this embodiment, inner track 26 is in the shape of an envoluted trochoid.

The housing depicted in FIG. 1 is a cut-away version of a complete housing (not shown). As will be apparent to those skilled in the art, the complete housing 12 (not shown) has two inner walls 32, each of which can be comprised of an inner track 26.

In the embodiment depicted in FIG. 1, a multiplicity of pins 18, 20, 22, and 24 are shown disposed on wall 34 of rotor 16; and these pins ride within a track (not shown) within an inner wall (not shown) of housing 12 which is located opposite the track 26 and the inner wall 32 depicted in FIG. 1. Similarly, a multiplicity of pins (not shown) are disposed on wall 36 of rotor 16 and ride within the track 26 of the wall 32 shown in FIG. 1.

As will be apparent to those skilled in the art, the rotary mechanism 10 may have pins disposed on wall 34 riding in a track 26 not shown, it may have pins disposed on wall 36 (not shown) riding in the track 26 shown, it may have pins disposed on both wall 34 and wall 36, or it may have pins disposed on neither of walls 34 and 36. In this last embodiment, the pins are disposed on one or both of the inner walls of the housing 12, and the track is disposed on one or more of the exterior walls of rotor 16.

In one embodiment, not shown, each of pins 18, 20, 22, and 24 are integral structures which extend through rotor 16 from wall 34 through wall 36, and beyond said walls so that they are adapted to ride in their respective tracks 26. In general, it is preferred that pins 18, 20, 22, and 24 extend beyond wall 34 and/or wall 36 by from about 1.0 to about 2.0 times the diameter of such pins. In general, the diameters of pins 18, 20, 22, and 24 will range from about 2 to about 4 times the eccentricity of eccentric 28. The eccentricity of eccentric 28 generally will be from about 0.05 to about 10 inches. It is preferred that the eccentricity be from about 0.15 to about 0.45 inches.

Figure 2:
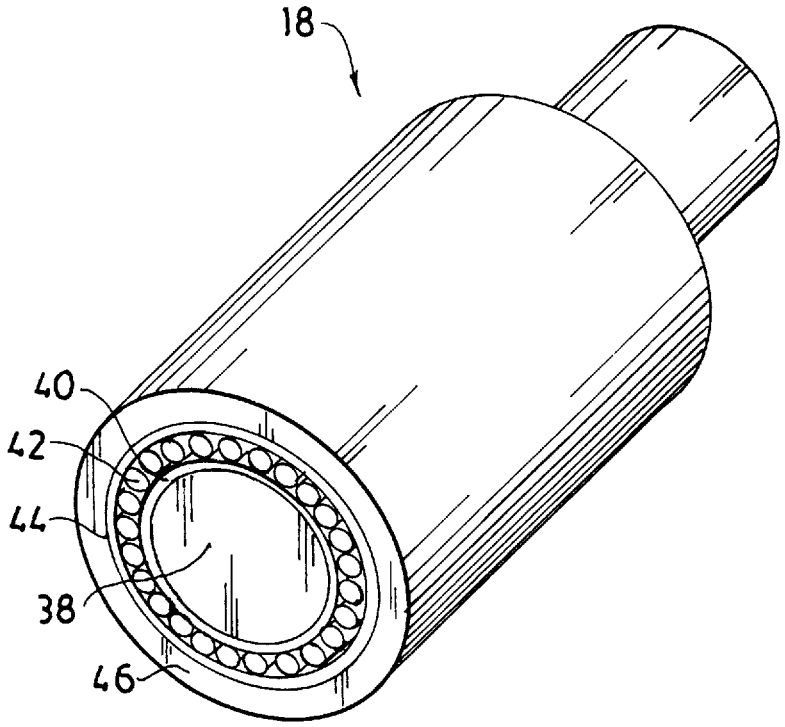
FIG. 2 is a perspective view of one pin used in the rotary mechanism of FIG. 2.
Figure 3:
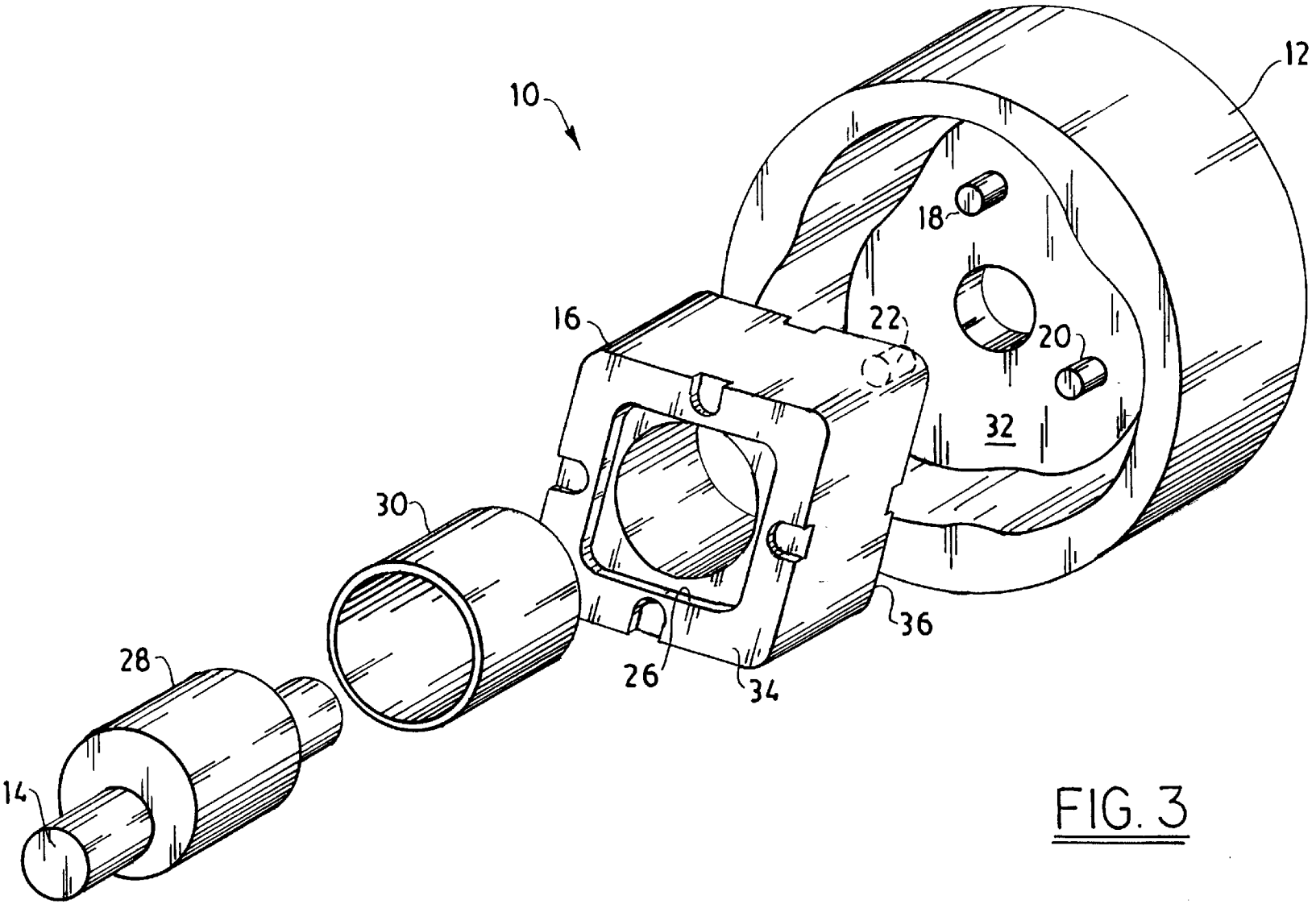
FIG. 3 is a perspective view of another preferred rotary mechanism of the invention.

FIG. 2 is a perspective view of a preferred pin 18 which is comprised of a body portion 38 which is attached either to rotor 16 (see FIG. 1) and/or to inner wall 32 of housing 12 (see FIG. 3). In the embodiment depicted in FIG. 2, the body portion 38 of pin 18 is disposed within an inner race 40 which, in turn, is contiguous with bearings 42. The bearings 42 are disposed within outer race 44, and the outer race assembly 44 may be disposed within an outer body 46. As will be apparent to those skilled in the art, the pin depicted in this Figure has a structure comparable to most rolling element bearings. See, e.g., U.S. Pat. Nos. 5,352,046, 5,271,679, 5,230,570, 4,526,485, 3,620,585, and the like. The disclosure of each of these United States patents is hereby incorporated by reference into this specification.

As will be apparent to those skilled in the art, the outer body assembly 46 can rotate around body 38 of pin 18 as pin 18 moves within track 26. It is thus preferred that outer body assembly 46 comprise or consist essentially of a material that provides a good wear couple with the material of track surface 26.

In another embodiment, not shown, pin 18 is comprised of only a pin body 38 contiguous with an outer body assembly 46. In this embodiment, the pin would have a structure comparable to most precision sleeve bearings.

Figure 4:
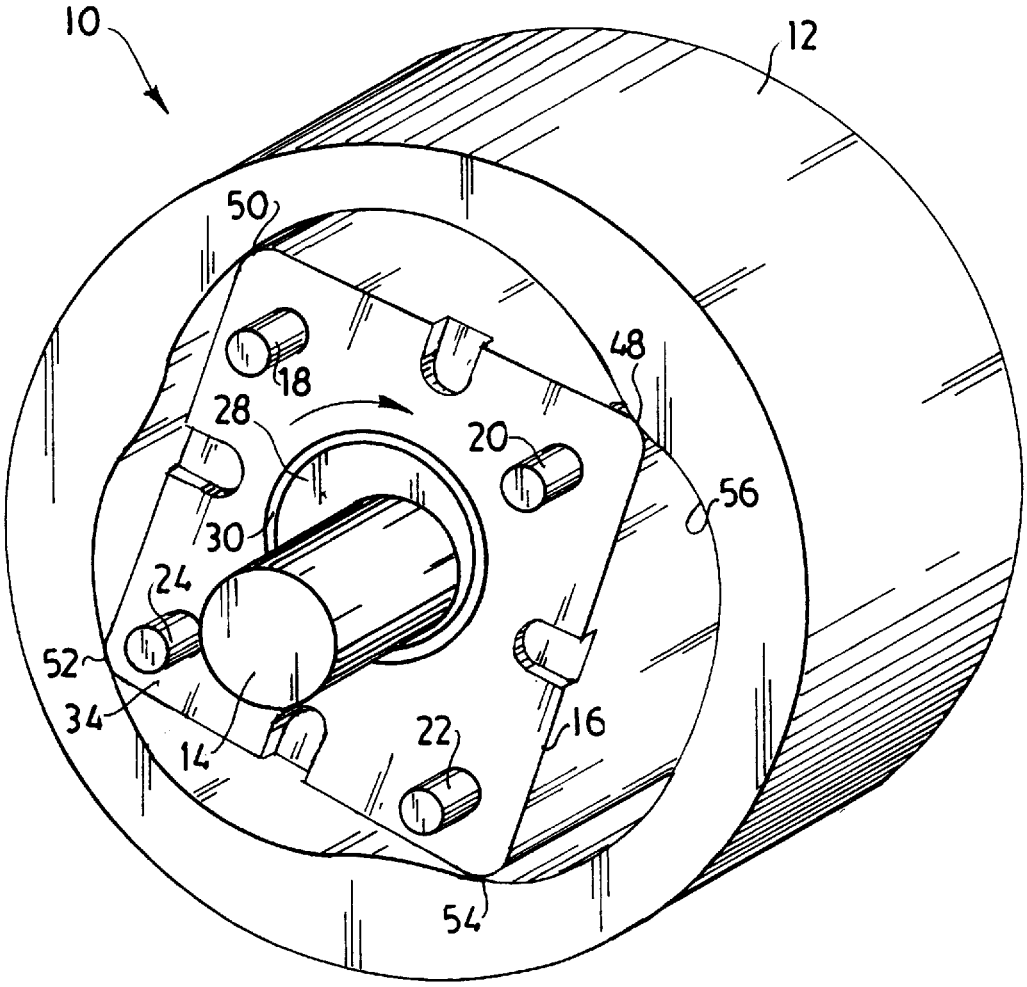
FIG. 4 is a perspective view of a portion of the rotary mechanism of FIG. 1.

FIG. 3 is a perspective view of another preferred embodiment in which which pins 18, 20, and 22 are connected on housing inner wall 32 and ride within a track 26 (not shown) disposed within the outer wall 36 of rotor 16. As will be apparent to those skilled in the art, for the sake of simplicity of representation, the portion of housing 12 containing pins which ride within the track 26 depicted is not shown. FIG. 4 is a perspective view of the assembly depicted in FIG. 1, showing such assembly in its assembled form. Referring to FIG. 4, it will be seen that rotor 16 is comprised of a multiplicity of apices 48, 50, 52, and 54 which are close to but not contiguous with the inner trochoidal surface 56 of housing 12.

In the embodiment depicted, the apices 48, 50, 52, and 54 form non-compliant seals with the trochoidal surface 56 of rotor 16. In another embodiment, not shown, the apices 48, 50, 52, and 54 are comprised of compliant surfaces which are deformable and thus will effectively conformally seal. Compliant seals are well known to those skilled in the art and are described, e.g., in U.S. Pat. Nos. 5,411,483 (laterally compliant seal), 5,407,433, 5,370,402 (pressure balanced compliant seal device), 4,978,590 (dry compliant seal), 4,606,706 (internal compliant seal for compressor); the disclosure of each of these United States patents is hereby incorporated by reference into this specification.

Figure 5:
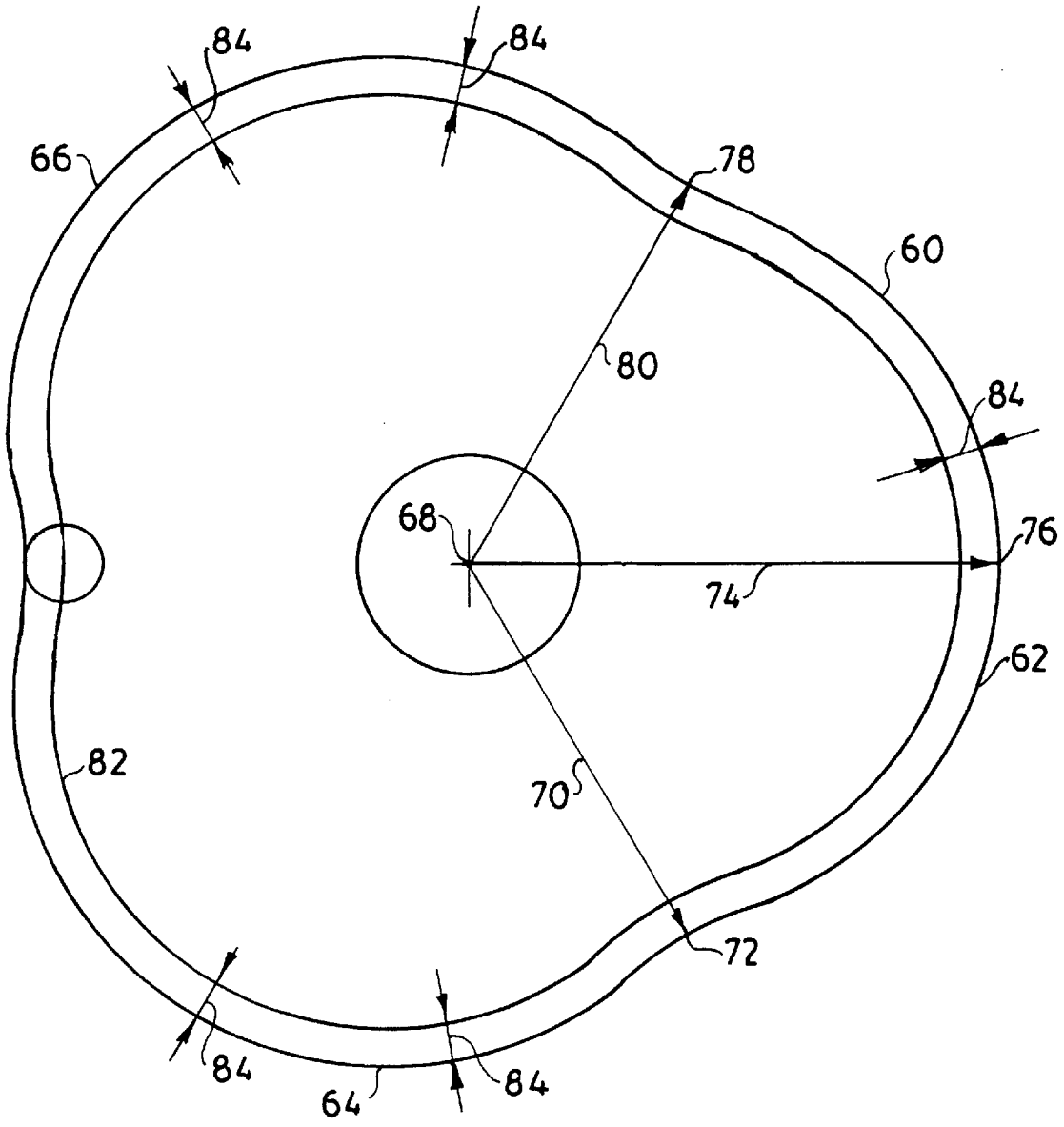
FIG. 5 is a schematic representation of the path followed by the tracking pins and rotor seals of the device of FIG. 1.

FIG. 5 is a schematic representation of trochoidal surface 82 and envoluted trochoidal surface 60 referred to in this specification. Referring to FIG. 5, and in the preferred embodiment illustrated therein, it will be seen that surface 60 defines a multiplicity of lobes 62, 64, and 66 which, in combination, define an inner surface 60 which has a continuously changing curvature.

Referring again to FIG. 5, it will be seen that, with regard to lobe 62, the distance from the centerpoint 68 to any one point on lobe 62 will preferably differ from the distance from the centerpoint 68 to an adjacent point on lobe 62; both the curvature and the distance from the centerpoint 68 is preferably continuously varying in this lobe (and the other lobes). Thus, for example, the distance 70 between point 68 and 72 is preferably substantially less than the distance 74 between points 68 and 76; as one progresses from point 72 to point 76 around surface 60, such distance preferably continuously increases as the curvature of lobe 62 continuously changes. Thereafter, as one progresses from point 76 to point 78, the distance 80 between point 68 and point 78 preferably continually decreases.

Referring again to FIG. 5, it will be apparent to those skilled in the art that, in this preferred embodiment, the same situation also applies with lobes 66 and 64. Each of such lobes is preferably defined by a continuously changing curved surface; and the distance from the centerpoint 68 is preferably continuously changing between adjacent points.

In the preferred embodiment illustrated in FIG. 5, it is preferred to have at least two of such lobes 62, 64, and 66. It is more preferred to have at least three of such lobes. In another embodiment, at least four of such lobes are present.

It is preferred that each lobe present in the inner surface 60 have substantially the same curvature and shape as each of the other lobes present in inner surface 60. Thus, referring to FIG. 5, lobes 62, 64, and 66 are displaced equidistantly around centerpoint 68 and have substantially the same curvature as each other.

The curved surface 60 may be generated by conventional machining procedures. Thus, as is disclosed in U.S. Pat. No. 4,395,206, the designations "epitrochoid" and "hypotrochoid" surfaces refer to the manner in which a trochoid machine's profile curves are generated; see, e.g., U.S. Pat. No. 3,117,561. The entire disclosure of this patent is hereby incorporated by reference into this specification.

An epitrochoidal curve is formed by first selecting a base circle and a generating circle having a diameter greater than that of the base circle. The base circle is placed within the generating circle so that the generating circle is able to roll along the circumference of the base circle. The epitrochoidal curve is defined by the locus f points traced by the tip of radially extending generating or drawing arm, fixed to the generating circle having its inner end pinned to the generating circle center, as the generating circle is rolled about the circumference of the base circle (which is fixed).

In one embodiment, the epitrochoidal curve is generated in accordance with the manner illustrated in FIG. 29 of U.S. Pat. No. 5,431,551, the entire disclosure of which is hereby incorporated by reference into this specification.

As is disclosed on lines 36 to 55 of column 5 of U.S. Pat. No. 4,395,206, it is common practice to recess or carve out the corresponding peripheral profile of the epitrochoid member a distance "x" equal to the outward offset of the apex seal radius (see FIG. 4 of such patent). As stated on lines 48 et seq., in ". . . the case of an inner envelope type device 20', as shown in FIG. 4, such carving out requires that the actual peripheral wall surface profile 33 which defines the cavity 34 of the housing 35 be everywhere radially outwardly recessed from the ideal epitrochoid profile 36. In the case of an outer envelope device 21', as illustrated in FIG. 5, such carving out requires that the actual peripheral face profile of the epitrochoid working member, rotor 38, be everywhere inwardly radially recessed from the ideal epitrochoid profile 39."

Referring again to FIG. 5, it will be seen that applicants' inner housing surface profile 60 is generated from ideal epitrochoidal curve 82 and is outwardly recessed from ideal curve 82 by a uniform distance 84. In one preferred embodiment, uniform distance 84 is a function of the eccentricity of the eccentric 28 used in device 10 (see FIG. 1).

Referring again to FIG. 1, it will be seen that rotary mechanism 10 is comprised of shaft 14 on which eccentric 28 is mounted. Shaft 14 preferably has a circular cross-section and is cylindrical in shape. Shaft 14 is connected to eccentric 28. In one embodiment illustrated in FIG. 1, shaft 14 and eccentric 28 are integrally formed and connected.

In one preferred embodiment, both shaft 14 and eccentric 28 consist essentially of steel such as, e.g., carbon steel contains from about 0.4 to about 0.6 weight percent of carbon.

FIG. 4 of U.S. Pat. No. 5,431,551 is a front view of the shaft/eccentric assembly of this patent, and discussion is presented in such patent of the eccentricity of such assembly. As is known to those skilled in the art, eccentricity is the distance of the geometeric center of a revolving body (eccentric 28) from the axis of rotation.

Referring again to FIG. 5, and in the preferred embodiment illustrated therein, it is preferred that the distance 84 be from about 0.05 to about 5.0 times as great as the eccentricity of eccentric 28 (see FIG. 1). In a more preferred embodiment, the distance 84 is from about 1.0 to about 2.0 as great as the eccentricity. In one embodiment, distance 84 is about 0 times as great as the eccentricity.

It will be apparent to those skilled in the art that FIG. 5 may refer to two separate trochoidal geometries. When FIG. 5 refers to the trochoidal geometry of track 26, then the distance 84 is equal to the radius of tracking pin 18, 20, 22, or 24. When FIG. 5 refers to the trochoidal geometry of inner trochoidal wall 56, then the distance 84 is equal to the radius of apex 48, 50, 52, or 54.

Figure 6:
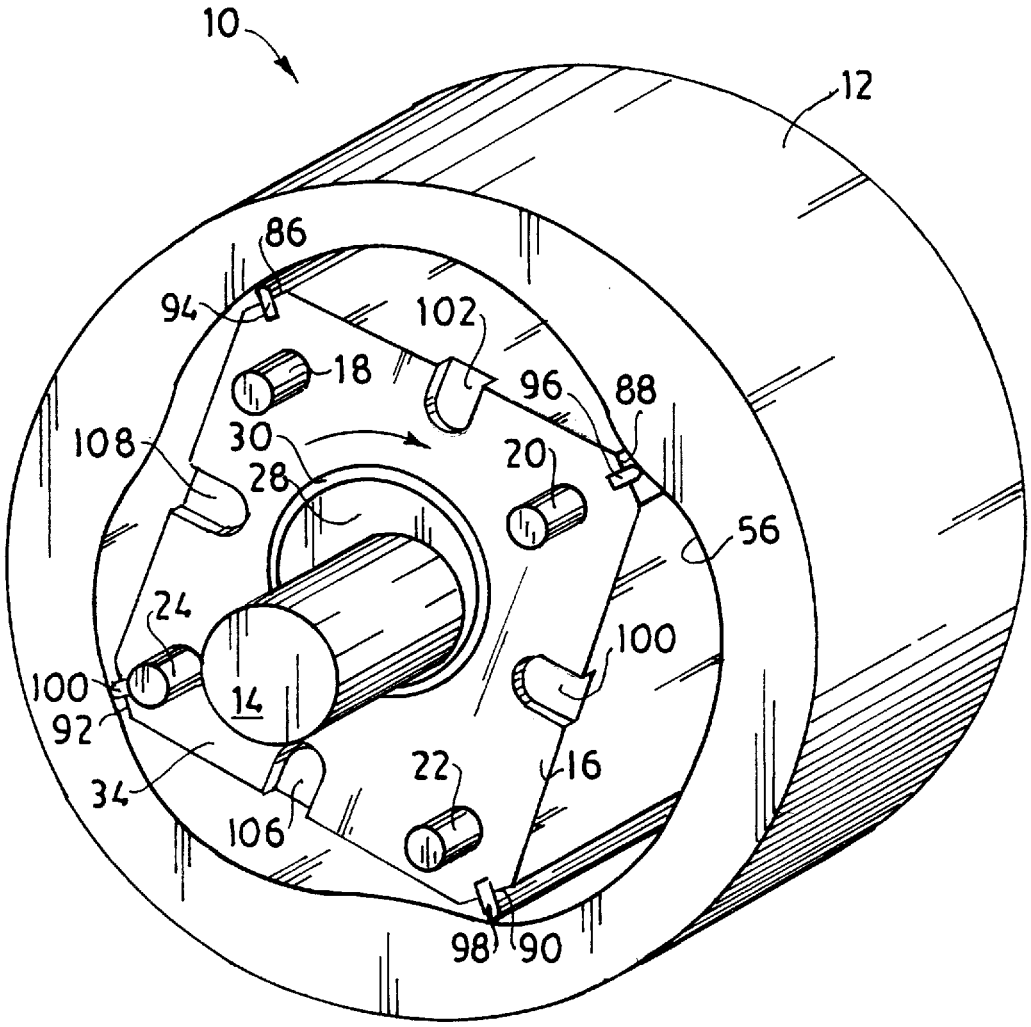
FIG. 6 is a perspective view of another preferred embodiment of the invention.

FIG. 6 is a perspective view of a rotor assembly 10 in which the apices 86, 88, 90, and 92 are not directly contiguous with inner surface 56 of housing 12. In this embodiment, inner surface 56 defines a theoretical trochoidal shape 82 (see FIG. 5).

Referring to FIG. 6, and in the preferred embodiment depicted therein, rotor apex seals 94, 96, 98, and 100 are disposed between apices 86, 88, 90, and 92 and are near to but not contiguous with inner surface 56.

Apex seals are well-known to those skilled in the art and are described, e.g., in U.S. Pat. Nos. 5,123,820 (pressure assisted apex seal), 5,049,051 (multi-piece tilted apex seal), 5,039,288 (apex seal for rotary engine), 4,954,058 (composite, sintered apex seal), 4,931,001 (apex seal with filled aperture), 4,863,533 (apex seal for rotary piston engine), 4,822,262 (rotary engine having rollers for apex seals) 4,403,930 (multi-piece apex seal), 3,985,477 (tube core apex seal), and the like. The disclosure of each of these United States patents is hereby incorporated by reference into this specification.

Referring again to FIG. 6, it is preferred that apex seals 94, 96, 98, and 100 be close to but not contiguous with surface 56. In general, these apex seals are disposed at a distance of from about 0.001 to about 0.002 inches away from inner surface 56.

Referring again to FIG. 6, it will seen that rotor 16 is comprised of recesses 102, 104, 106, and 108. These recesses have substantially the same structure and function as the recesses 64, 66, 68, and 70 of FIG. 5 of U.S. Pat. No. 5,431,551, the entire disclosure of which is hereby incorporated by reference into this specification.

Figure 7:
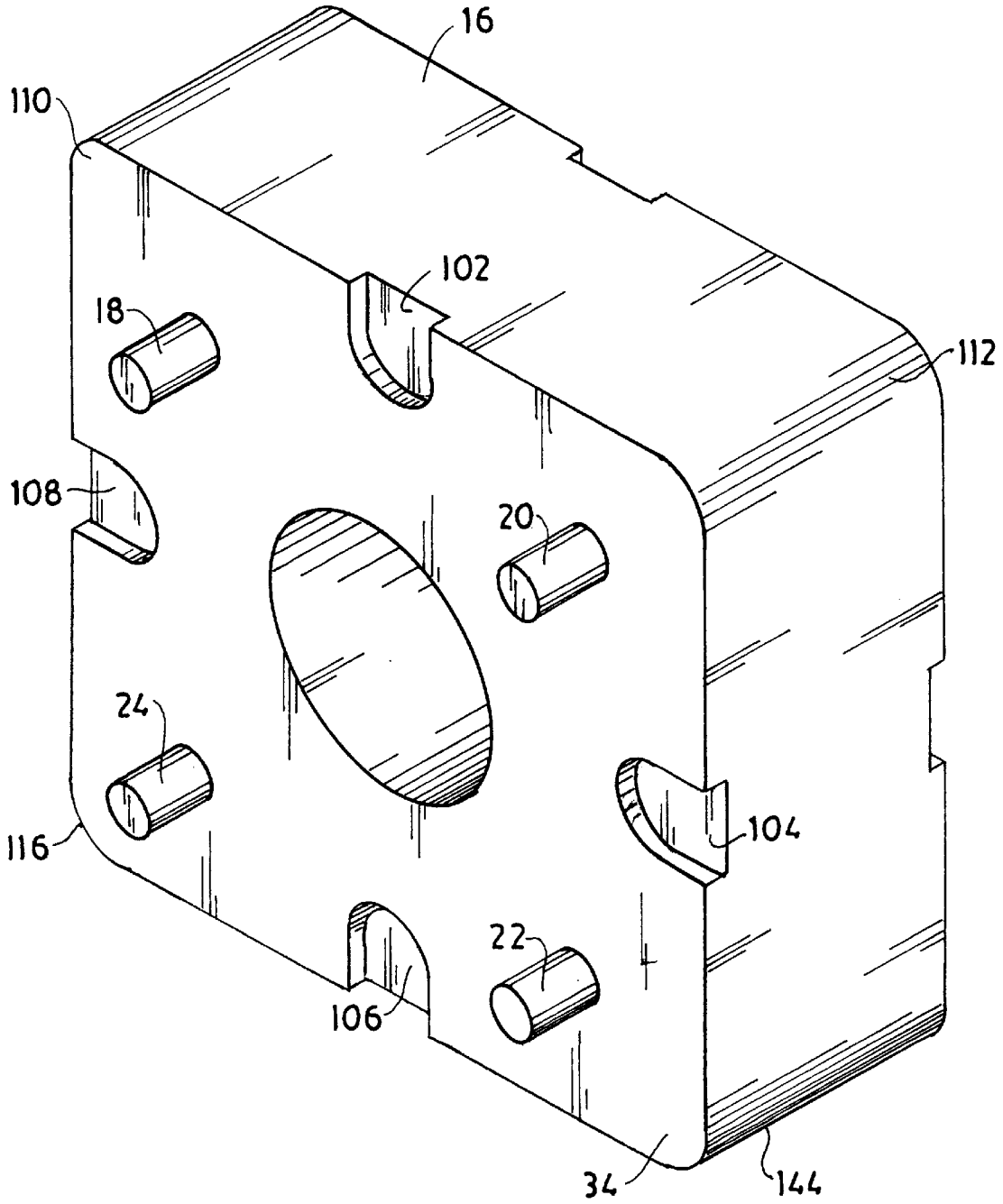
FIG. 7 is a perspective view of the rotor used in the device of FIG. 1.

FIG. 7 is a perspective view of a rotor 16 which does not contain compliant seals at its apices 110, 112, 114, and 116. As will be apparent to those skilled in the art, the non-compliant sealing surfaces at apices 110, 112, 114, and 116 will describe upon close clearance approach an envoluted trochoidal surface (see surface 60 of FIG. 5, and surface 56 of FIG. 4).

Figure 8:
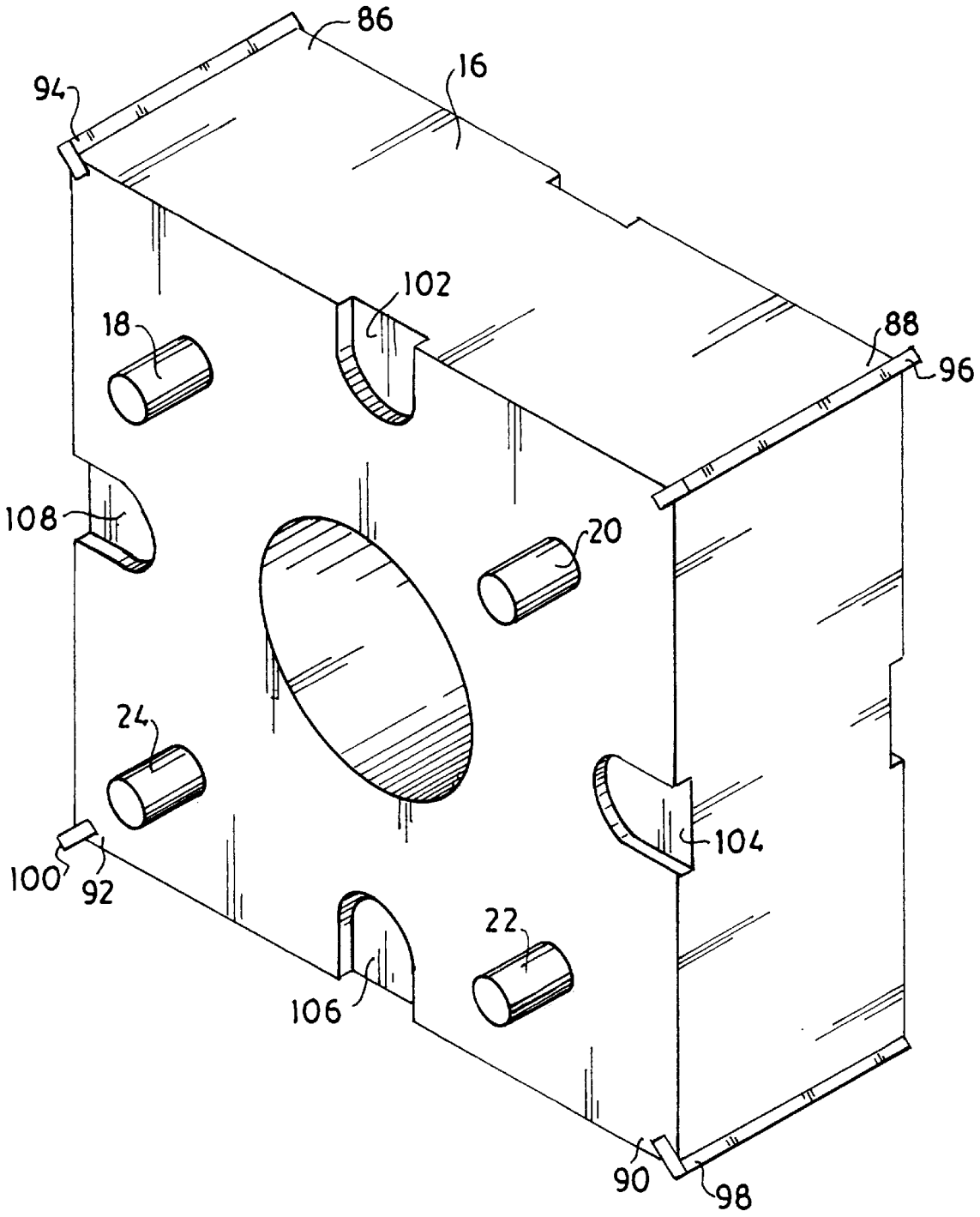
FIG. 8 is a perspective view of the rotor used in the device of FIG. 6.
Figure 9:
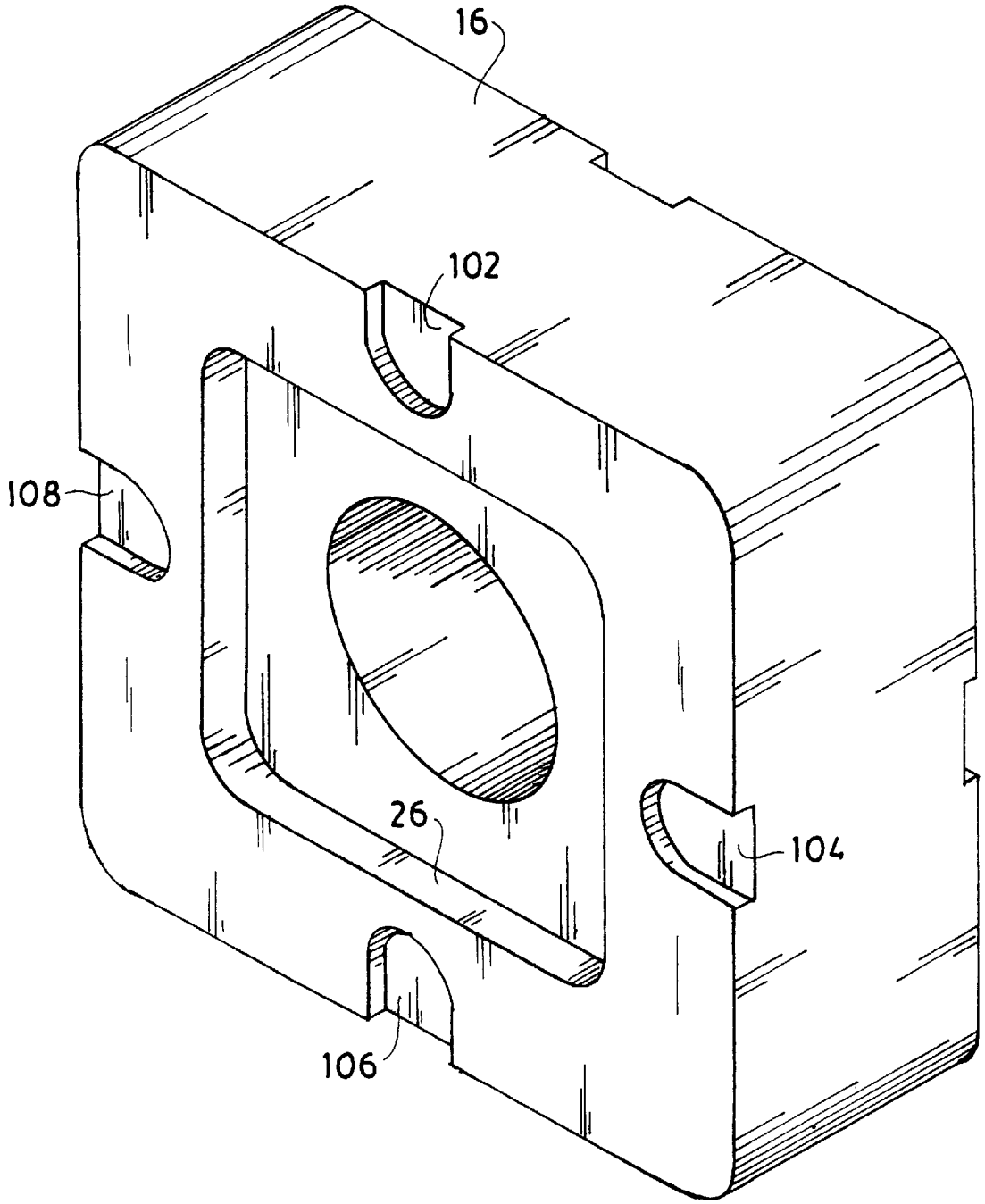
FIG. 9 is a perspective view of the rotor used in the device of FIG. 3.

FIG. 8 is perspective view of the rotor depicted in the device of FIG. 6. As will be apparent to those skilled in the art, in the embodiment depicted, the apex seals 94, 96, 98, and 100 are non-compliant. In another embodiment, not shown, these apex seals 94, 96, 98, and 100 are made compliant by the inclusion of spring means (not shown) which urges these seals towards inner surface 56 (not shown). In yet another embodiment (not shown), these apex seals 94, 96, 98, and 100 can be made compliant by the use of deformable material, such as, e.g., polytetrafluoroethylene materials.

FIGS. 10A, 10B, 10C, and 10D are is a schematic representation of a rotor 16 with different types of sealing surfaces on each of its apices.

Figure 10:
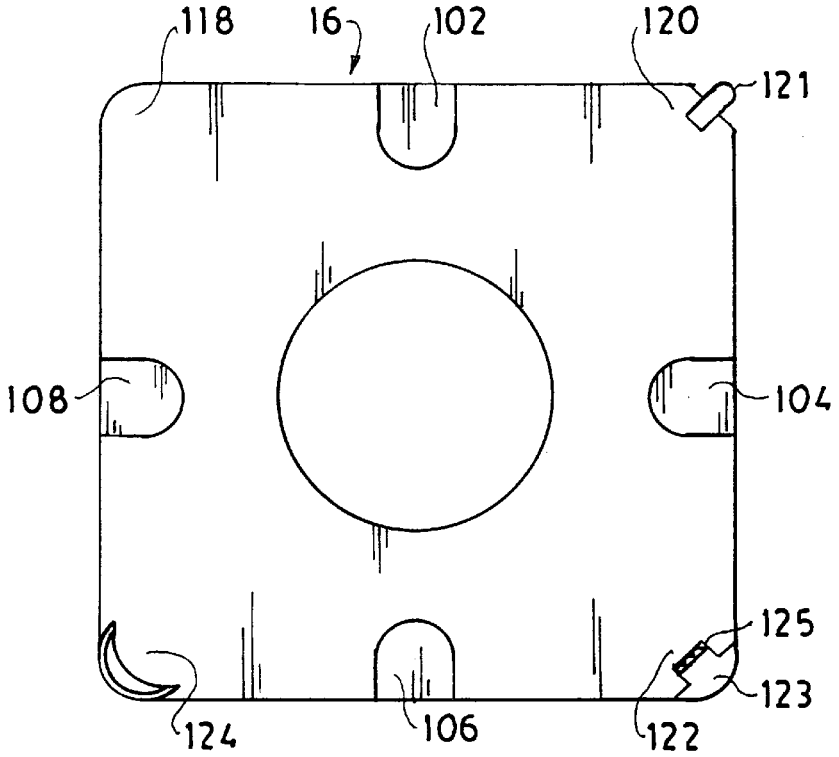
FIGS. 10A, 10B, 10C, and 10D are schematic representations of a rotor with a solid curved surface, a strip seal, a spring-loaded seal, and a strip of material, respectively, disposed at each of its apices for sealing purposes.
Figure 10A:
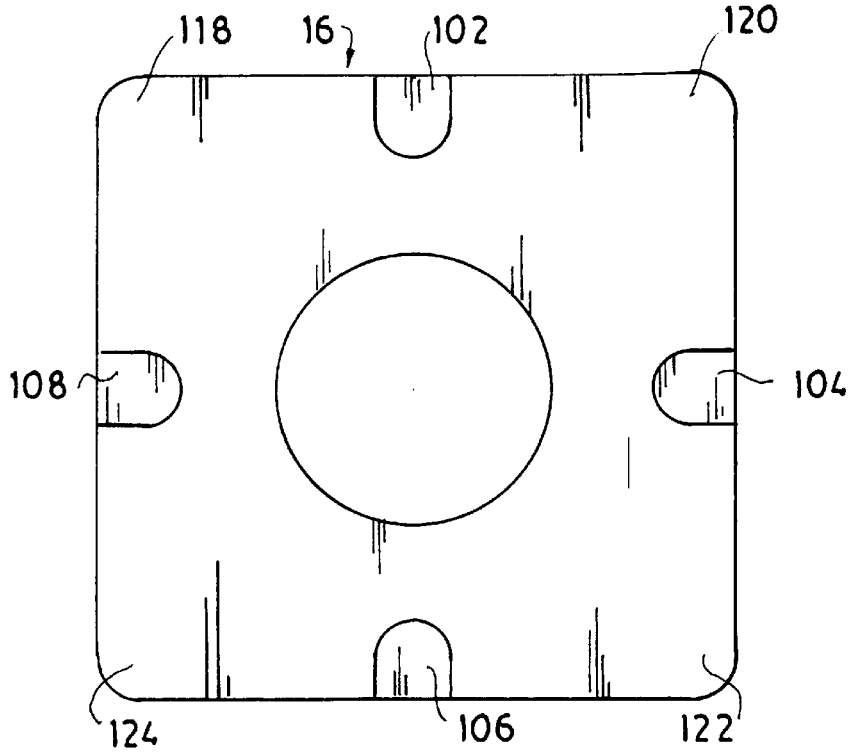
Figure 10B:
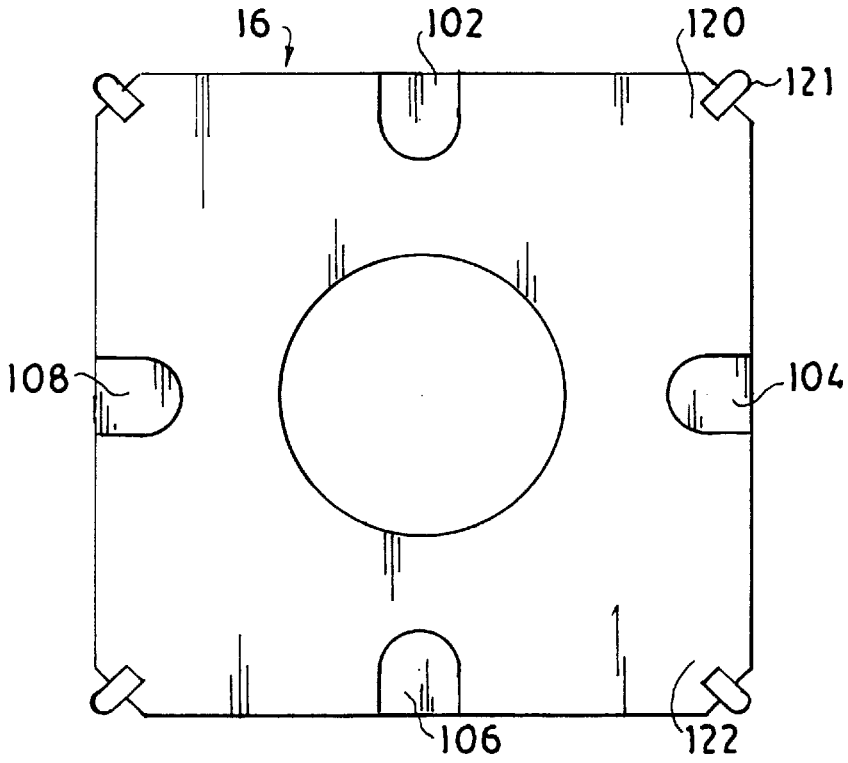
Figure 10C:
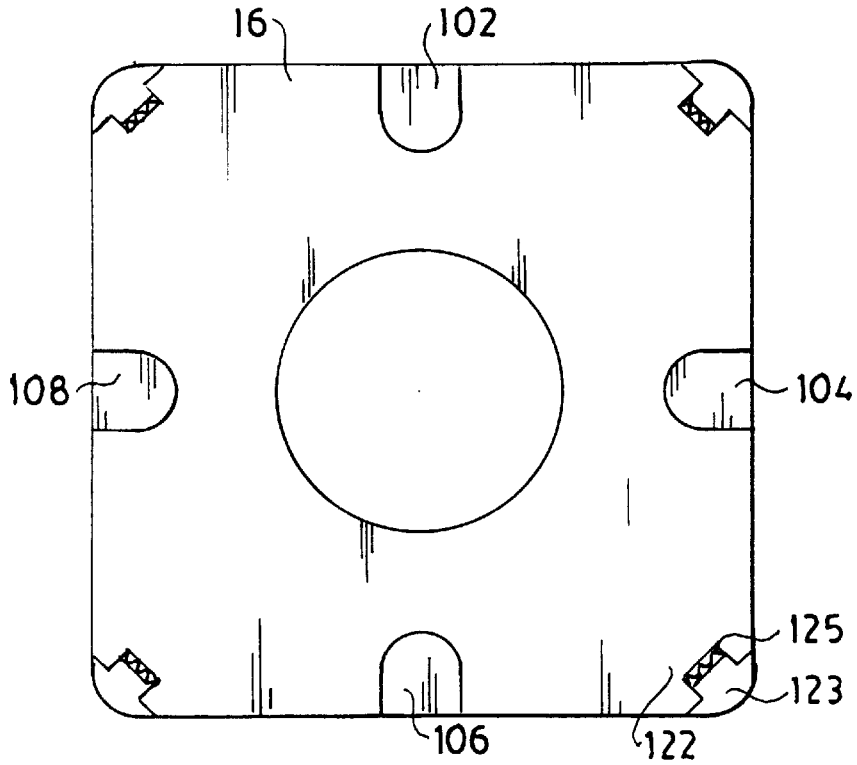
Figure 10D:
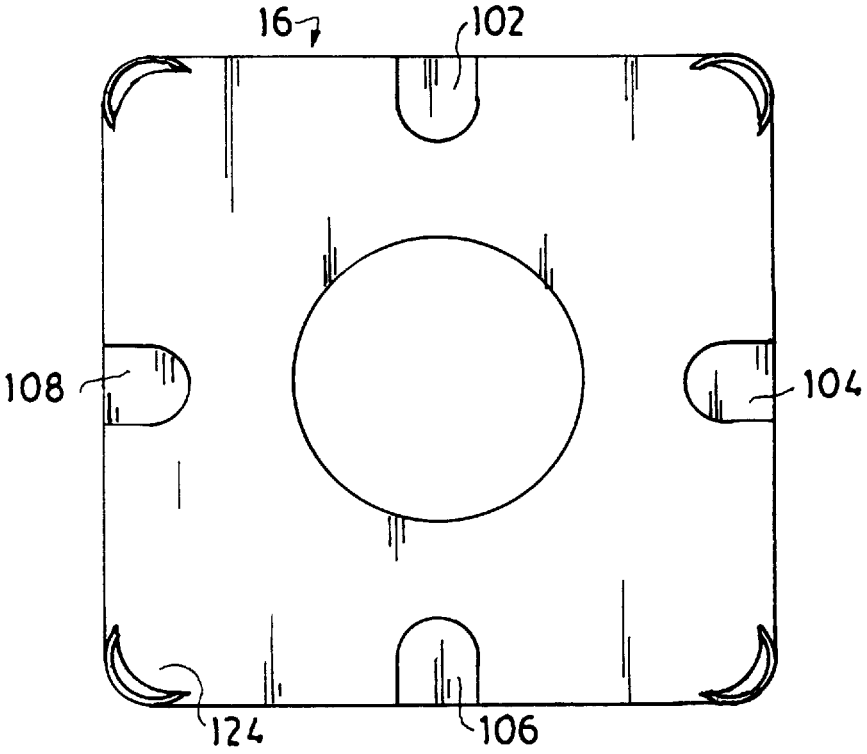

Referring to FIG. 10A, it will be seen that apex 118 is preferably a solid curved surface which is made from the same material as is rotor 16. In this embodiment, the apex 118 is non-compliant, it provides close-clearance sealing at a distance of from about 0.001 to about 0.002 inches from inner surface 56 of the housing (not shown), and it will describe an envoluted trochoidal geometry during its operation.

Referring again to FIG. 10B, apex 120 is connected to an apex seal 121. In the embodiment depicted, apex seal 121 is a linear strip seal which is disposed within to rotor 16. Linear strip seal 121 can be metallic or non-metallic.

In one embodiment, where apex seal 121 is a fixed strip of material, it provides close-clearance sealing at a distance of from about 0.001 to about 0.002 inches from inner surface 56 and describes an ideal trochoidal geometry during its operation. In another embodiment, where the seal 121 is made compliant by conventional means, it provides substantially zero clearance sealing and also describes an ideal trochoidal geometry during its operation.

Referring again to FIG. 10C, apex 122 is comprised of a separate curved surface 123 affixed to apex 122 and made complaint by virtue of the presence of spring 125. In this embodiment, the apex 122 provides substantially 0 clearance sealing and describes an envoluted trochoidal geometry during its operation. As will be apparent to those skilled in the art, the surface 123 may consist of an ultra-high molecular weight plastic.

Referring again to FIG. 10D, apex 124 is comprised of separate curved surface 127 which is formed from a strip of material pressed into a recess (not shown) in rotor 16. If this curved surface 127 is made from compliant material, apex 124 will also be complaint and, during operation, will provide substantially zero clearance and will describe an envoluted trochoidal geometry during its operation. A port (not shown) communicating with the pressurized portion of a pressurized volume (not shown) may be employed to pressure the back the curved surface 127, such that improved clearance control is achieved at higher pressures. In a similar manner, an equalizing pressure can also be applied to linear strip 121 and/or surface 123.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A rotary device comprised of a housing comprising a curved inner surface in the shape of a trochoid and an interior wall, an eccentric mounted on a shaft disposed within said housing, a first rotor mounted on said eccentric shaft which is comprised a first side and a second side, a first pin attached to said rotor and extending from said rotor to said interior wall of said housing, and a second pin attached to said rotor and extending from said rotor to said interior wall of said housing, and a third pin attached to said rotor and extending from said rotor to said interior wall of said housing, wherein:

(a) a continuously arcuate track is disposed within said interior wall of said housing, wherein said continuously arcuate track is in the shape of an envoluted trochoid, (b) said first pin has a distal end which is disposed within said continuously arcuate track, (c) said second pin has a distal end which is disposed within said continuously arcuate track, (d) said third pin has a distal end which is disposed within said continuously arcuate track, (e) said distal end of said first pin is comprised of a shaft disposed within a first rotatable sleeve, (f) said distal end of said second pin is comprised of a shaft disposed within a second rotatable sleeve, (g) said distal end of said third pin is comprised of a shaft disposed within a third rotatable sleeve, (h) said rotor is comprised of a multiplicity of apices, wherein each such apex forms a compliant seal with said curved inner surface, and wherein each said apex is comprised of a separate curved surface which is formed from a strip of material pressed into a recess, (i) said curved inner surface of said housing is generated from an ideal epictrochoidal curve and is outwardly recessed from said ideal epitrochoidal curve by a distance of from about 0.05 to about 5 times as great as the eccentricity of said eccentric, (i) the diameter of the distal end of each of said first pin and said second pin is from about 2 to about 4 times as great as said eccentricity of said eccentric, (k) each of said first pin, said second pin, and said third pin extends from beyond said interior wall of said housing by from about 1 to about 2 times the diameter of each of said pins.

2. The rotary device as recited in claim 1, wherein said curved inner surface of said housing is in the shape of an envoluted trochoid.

3. The rotary device as recited in claim 1, wherein said device is comprised of a fourth pin attached to said rotor.

4. The rotary device as recited in claim 3, wherein said fourth pin is disposed within said continuously arcuate track.

5. The rotary device as recited in claim 1, wherein said first rotor is comprised of a first arcuate apex, and second arcuate apex, and third arcuate apex.

6. A rotary device comprised of a housing comprising a curved inner surface in the shape of a trochoid and an interior wall, an eccentric mounted on a shaft disposed within said housing, a first rotor mounted on said eccentric shaft which is comprised a first side and a second side, a first pin attached to said interior wall of said housing and extending from said interior wall of said housing to said rotor, and a second pin attached to said interior wall of said housing and extending from said interior wall of said housing, wherein:

(a) a continuously arcuate track is disposed within said rotor, wherein said continuously arcuate track in the shape of an envoluted trochoid, (b) said first pin has a distal end which is disposed within said continuously arcuate track, (c) said second pin has a distal end which is disposed within said continuously arcuate track, (d) said distal end of said first pin is comprised of a shaft disposed within a first rotatable sleeve, (e) said distal end of said second pin is comprised of a shaft disposed within a second rotatable sleeve, (f) said rotor is comprised of a multiplicity of apices, wherein each such apex forms a compliant seal with said curved inner surface, and wherein each said apex is comprised of a separate curved surface which is formed from a strip of material pressed into a recess, (g) said curved inner surface of said housing is generated from an ideal epictrochoidal curve and is outwardly recessed from said ideal epitrochoidal curve by a distance of from about 0.05 to about 5 times as great as the eccentricity of said eccentric, (h) the diameter of the distal end of said first pin and said second pin is from about 2 to about 4 times as great as said eccentricity of said eccentric;

(i) each of said first pin and said second pin extends beyond a side of said rotor by from about 1 to about 2 times the diameter of each of said pins.

7. The rotary device as recited in claim 6, wherein said curved inner surface of said housing is in the shape of an envoluted trochoid.

8. The rotary device as recited in claim 6, wherein said first rotor is comprised of a first arcuate apex, and second arcuate apex, and third arcuate apex.

* * * * *